United States Patent [19]

Owen et al.

[11] Patent Number: 4,637,217

[45] Date of Patent: Jan. 20, 1987

[54] RAPID CONSTRUCTION OF ICE STRUCTURES WITH CHEMICALLY TREATED SEA WATER

[75] Inventors: Lawrence B. Owen, Salt Lake City, Utah; Daniel M. Masterson, Calgary, Canada; Sidney J. Green, Salt Lake City, Utah

[73] Assignees: Terra Tek, Inc., Salt Lake City, Utah; Geotechnical Resources Ltd., Calgary, Canada

[21] Appl. No.: 757,157

[22] Filed: Jul. 22, 1985

[51] Int. Cl.[4] ..... E02D 17/00

[52] U.S. Cl. ..... 62/74; 62/260; 405/217

[58] Field of Search ..... 62/66, 74, 260, 340, 62/347; 405/217, 61; 252/70

[56] References Cited

U.S. PATENT DOCUMENTS

| | | | |
|---|---|---|---|
| 1,415,325 | 5/1922 | Ellis | 62/66 |
| 4,048,808 | 9/1977 | Duthweiler | 62/260 X |
| 4,192,630 | 3/1980 | Duthweiler | 62/260 X |
| 4,325,656 | 4/1982 | Bishop | 62/260 X |
| 4,373,836 | 2/1983 | Cox et al. | 62/260 X |
| 4,432,669 | 2/1984 | Cox et al. | 62/260 X |
| 4,523,879 | 6/1985 | Finucane et al. | 62/260 X |

*Primary Examiner*—William E. Wayner

*Attorney, Agent, or Firm*—Beehler, Pavitt, Siegemund, Jagger, Martella & Dawes

[57] ABSTRACT

A method for accelerating the freezing of sea water by two different, but related approaches. One involves the use of fluorinated or fluorochemical surfactants, other surfactants with specific activity in saline water, and the other by treatment with ice nucleation agents or the use of both. The specific application for the process is construction of improved load bearing ice structures as used in Arctic regions in supprot of hydrocarbon exploration and production activities.

13 Claims, No Drawings

RAPID CONSTRUCTION OF ICE STRUCTURES WITH CHEMICALLY TREATED SEA WATER

BACKGROUND OF THE INVENTION

The present invention relates to an improved method for accelerating the freezing of propelled sea water streams or impounded masses of sea water by treatment of the sea water with surfactant or ice nucleation agents or both with the result that the ice structure is stronger than conventionally formed ice structures fabricated from brine or sea water. The advantageous treatment of a propelled continuous stream of sea water with surfactant is directly attributable to the significant reduction in surface tension of the sea water and the resulting droplet formation and breakup which results in improved heat exchange with the ambient air and, as a consequence, more rapid cooling of the sea water. This is accomplished while maintaining the necessary relatively long horizontal transport of the stream and while maintaining the relatively large volume of sea water used in the formation of engineered ice structures from brine and the like.

Ice nucleation agents cause water droplets or impounded masses of water to freeze more rapidly by prevention or minimization of supercooling. The phenomena of supercooling is detrimental because water is able to persist as a liquid at a temperature nominally lower than the normal freezing temperature of the water. Rapid freezing of sea water is important in certain applications such as the construction of load-bearing ice structures in offshore Arctic regions where such structures are employed in conjunction with hydrocarbon exploration and production and in the construction of airfields, roads, camps and the like. In these applications, sea water is used exclusively as the aqueous medium and construction is usually started as soon as the ambient air temperature is sufficiently low to cause freezing of the sea water. It is economically advantageous to be able to cause the freezing of sea water to proceed as rapidly as possible so that load-bearing structures may be constructed in a relatively short period of time as compared to the methodology heretofore used.

A method commonly employed to form ice structures involves the propelling of sea water through the air as an essentially stream of sea water and over significant horizontal distances. The volume of the continuous stream may range up to 30,000 gallons per minute from a single nozzle used to propel the salt water over the needed distance. The air, by virtue of its low temperature with respect to the nominal freezing temperature of sea water (−1.6 to −2.0 degrees C. depending on salinity), acts as a coolant. The formation of droplets and the interaction of the sea water stream/droplet spray with cooler air results in freezing of the projected droplet spray. The efficiency of freezing depends on efficient heat exchange between the sprayed droplets and air. Formation of water droplets and the size of the droplets ultimately governs freezing efficiency at any ambient air temperature less than the nominal freezing temperature of the sea water. At the spray nozzle, the bulk of the sea water is in the form of a solid stream of water having high momentum in order to cover the desired relatively large horizontal distance. In the vicinity of the nozzle, shear and turbulent forces along the periphery of the water stream initiate droplet breakup and segregation. Along the trajectory of the stream/droplet spray, wind forces and gravitational forces promote increasing droplet breakup and segregation. Maximum droplet breakup, in the absence of significant wind forces, occurs at the apogee of the stream trajectory. The surface tension of the sea water is the fundamental property which governs how soon discrete water droplets will form and their size distribution for any imposed set of ambient conditions.

Load-bearing ice structures are also commonly built by forming a berm or dike and then flooding the impounded area with sea water, the process being repeated, after freezing of the sea water, as necessary until a desired thickness of ice has formed. Ice structures which are used as the support unit for large drill rigs are themselves large. Construction may require one or more months. It is necessary, therefore, to accelerate the ice construction phase so as to allow maximum time for drilling activities prior to the onset of the Spring thaw. The more or less routine application of flooding-spraying technology in conjunction with offshore Arctic applications is described in the prior art, U.S. Pat. No. 4,048,808 being a typical example.

In the production of snow as might be practiced at a ski resort, low salinity and typically fresh water is used and the water must be sprayed initially in the form of finely divided droplets in order to form snow in contrast to ice. The ratio of water to air is significantly lower than would be the case in a typical ice construction project. Atomizing nozzles are routinely used in snow making to promote quick formation of fine drops and to tailor the water droplet size distribution to promote rapid snow formation. Snow consists of masses of ice crystals or single ice crystals with a flat or platy morphology which form when finely divided water droplets are cooled by contact with ambient air. A formal definition of snow as either a loosely coherent cluster of ice crystals or as detached single ice crystals is mentioned in U.S. Pat. No. 2,676,471. In snow making operations, all water that is sprayed must be converted to snow before contact with the ground to prevent formation of ice that would be detrimental to skiing. The primary means used to make snow is rapid atomization of a water stream into relatively fine drops in order to improve air-water heat exchange. Atomization produces a distribution of droplets with low momentum. That is to say the production of fine droplets relatively close to the atomizing nozzle is inconsistent with a requirement to propel the water over a considerable horizontal distance and the formation of load-bearing ice. In snow making this limitation is an acceptable trade-off because of the significant aspect ratio of a typical ski run (length to width) and the desire to form what approximates natural snow rather than ice, the latter being objectionable for skiing. Snow making machines are moved as necessary to provide appropriate slop coverage and it is not necessary for the equipment to project streams over relatively long distances or to use the relatively large volumes of liquid used in the formation of engineered ice structures designed for relatively high loads.

A snow making operation is intended to cover a limited radial area, with respect to the snow making apparatus, with dry snow. The manufactured snow need not have any load-bearing capability. Ice nucleation agents and expanding gas streams have been described in the prior art as means of making snow production more efficient when ambient temperatures are relatively warm, largely as a result of the formation of relatively fine droplets. U.S. Pat. Nos. 3,887,580 and 4,200,228, for example, describe the use of ice nucleation agents in the production of dry snow from fresh water.

In ice construction, where the aim is to build a substantial load-bearing structure of a relatively large dimension, dry snow is undesirable and detrimental because snow contributes to a general weakening of the manufactured structure and snow does not possess the substantial strength of ice. Thus, the criteria and the porcedures normally used in snow making are of no significant use in the production of load-bearing ice structures formed of salt water or brine.

In accordance with this invention, it has been discovered that the governing property of a high volume sea water stream is formation of water droplets varying in size from 1 to about 30 mm in diameter. These droplets freeze in the form of hailstones, which are rounded or spherical masses of ice. The interior of the frozen droplets commonly contain liquid water of high salinity consistent with finite freezing rates and thermodynamic constraints that govern the freezing of saline solutions having a true eutectic. Successful ice construction requires that the projected sprayed material which falls to the surface have a liquid content. Some droplets crush on impact releasing additional brine. The fallen material undergoes partial melting and then refreezing. Excess brine drains away from the structure by virtue of its reduced freezing temperature caused by partial evaporation during flight and by salt rejection that occurs simultaneously with freezing. On impact with the ground, the brine is released and there is some partial melting of the frozen material. The newly formed slush then refreezes upon exposure to ambient temperature air. The refreezing which occurs after impact is the phenomena that is responsible for strength development in sprayed ice.

Thus, for example, the typical internal structure of a grounded ice island consists of cyclic layers of relatively strong, hard ice overlying a layer of softer material. This layering reflects the spraying cycle where the sea water stream is sprayed for a period of time and then spraying is suspended for a period of time to allow the sprayed material to freeze more completely. Freezing occurs from the air-ice interface downward. As an ice layer forms at the interface, material underneath is insulated and freezes at a reduced rate. During the next cycle of spraying, the hard frozen of the previous cycle is contacted again with brine and it undergoes partial melting. This cycle continues for the duration of the conventional ice construction.

Burial of dry snow does not lead to ice production on any useful timescale. In ice formation, nozzle spray parameters (volumes of fluid, elevation angle and direction of stream) must be constantly adjusted to avoid production of dry snow. Treatment of a sea water stream with surfactant is advantageous because droplet breakup is encouraged by surface tension reduction and the droplet size distribution may be shifted to smaller droplet sizes without significantly impacting the horizontal distance over which sea water is projected. Application of ice nucleation agents to a sea water stream is also advantageous by minimization of supercooling that might otherwise retard the rate at which the sprayed stream/droplet material freezes during transit from the nozzle and after impact of partially frozen material. Optimum benefit can be achieved by treatment of a sea water stream with both surfactants and ice nucleation agents in order to achieve the desired drop formation at the proper point in the stream transit and to reduce the adverse effects of supercooling.

Ice construction using flooding techniques is effective because it is possible to freeze a shallow impounded mass of water. Cooling occurs at the water-air interface. An intrinsic property of water is the attainment of maximum density at a temperature slightly above its freezing temperature. This property allows for more uniform cooling of a large impounded water mass. The advantageous application of an effective ice nucleation agent in flooding operations is due to the minimization of supercooling that could result in significant amounts of brine trapped in an ice structure. Brine pockets in an engineered ice structure, formed by a spraying technique or through freezing of an impounded mass or both, contribute to a general weakening of the structure and are, thus, undesirable.

In summary, important distinctions can be made between engineering requirements for snow production and ice construction. In snow making, water is atomized to improve heat exchange efficiency with the ambient air. This requirement precludes high volumetric flow rates from a single nozzle and also limits the maximum horizontal distance that the water droplets may be discharged from a single nozzle owing to the low momentum of very fine droplets. In ice construction in accordance with this invention, nozzles are selected which form continuous water streams because the objective is to spray large volumes of water over a substantial horizontal distance where 50 to 100 meter radii or more is typical. The air-to-water heat exchange is poor in comparison to a typical snow making operation. As a further distinction, snow making employs fresh water whereas in Arctic regions, sea water is used exclusively in ice construction. Finally, snow making has as its objective, production of dry snow consisting of flat or platy clumps of ice crystals or of single ice crystals of the same morphology. The end product is insufficient as a load-bearing structure. In contrast, ice construction by either spraying or flooding techniques has as its objective production of ice with substantial load-bearing capability. Sea water spraying produces spherical hailstones which may contain entrained brine. The transformation of these hailstones to ice involves partial melting after impact and rapid refreezing. Dry snow in this context is detrimental and counterproductive to the timely completion of an engineered structure.

SUMMARY OF THE INVENTION

Briefly, in the present invention, a combination of laboratory experimentation and field trials have demonstrated that water soluble surfactants significantly accelerate the freezing of sea water sprayed streams resulting in stronger ice structures which may be fabricated in a shorter period of time. The activity of the tested surfactants with respect to their impact on spray freezing stems from the reduction of sea water surface tension which encourages more efficient breakup of continuous water streams into droplets of a size that is smaller than would be obtained under identical ambient conditions in the absence of the surfactant, but considerably larger than has been the practice in atomizing water for snow formation. Significantly, enhanced droplet breakup can be obtained with no significant adverse impact on the nominal horizontal distance over which an untreated sea water stream can be directed. Thus, advantageous use of these surfactants permits large volumes of sea water to be propelled over considerable horizontal distances in a manner consistent with accepted practices for spray construction of ice structures and with much improved results in terms of rate of freezing and rate at which load bearing structures may be fabricated as well as the improved strength thereof. Furthermore, laboratory investigations have demonstrated how agents with activity as ice nucleation promoters may be used to advantage in ice construction either by spraying or flooding. The method by which an ice nucleation agent promotes freezing of water droplets is a subject of the prior art, U.S. Pat. Nos. 2,962,450, 3,056,556, 3,127,107, 3,272,434, 3,434,661, 3,567,117, 3,596,476, 3,703,991 and 3,979,061 being typical examples.

The mechanisms of activity of surfactants and ice nucleators by which freezing of water is enhanced are fundamentally different. Surfactants are primarily useful in enhancing sea water stream spray freezing where reduced surface tension causes reduced droplet size thereby promoting more efficient cooling and more rapid freezing by contact with ambient temperature air. Ice nucleators diminish supercooling and thereby promote more rapid freezing of either single water droplets or of a larger mass of impounded water. Thus, utilization of surfactants and ice nucleators alone or in concert can be expected to enhance freezing of sea water sprays. Freezing of an impounded mass of water would benefit from prior treatment with an ice nucleator. Surfactant usage in this context would offer no significant benefit. Documentation of the benefits to an ice construction project by use of surfactants and ice nucleation agents represents a unique application not mentioned in the prior art, an application that has been substantiated by laboratory and field demonstrations.

DETAILED DESCRIPTION OF THE INVENTION

Ice construction applications involving the freezing of sea water stream sprays benefit from a reduction in sea water surface tension because such reduction in surface tension encourages earlier droplet breakup and production of smaller droplets with a corresponding improvement in heat exchange efficiency with the ambient air. This is accomplished without compromising the distance over which the stream is propelled. In spraying applications where sea water is the aqueous medium or where an aqueous medium other than fresh water is used, significant reduction in water surface tension is not easily achieved. As a class, the fluorochemical surfactants provide substantial reduction in saline water surface tension over a wide temperature range and at extremely low treatment levels where less than 100 ppm of surfactant is effective. Above a level of about 100 ppm, the primary consideration is one of economics. This behavior is well documented and is part of the public domain technical literature. For example, fluorochemical surfactants available under the trade mark "FLORAD", grade FC-750 and FC-760, manufactured by the 3M Company of St. Paul, Minn., are used as oil and gas well stimulation additives as described in 3M product information Bulletins and in technical publications (Clark et al, WaterSoluble Fluorochemical Surfactant Well Stimulation Additives: JPT, July 1982; Clark, use of Fluorochemical Surfactants in Nonaqueous Stimulation Fluids; JPT, October, 1980). In comparison to hydrocarbon based surfactants, the fluorocarbon materials have a stabilizing fluorocarbon "tail" and a solubilizing group at the other end of the chain. The FC-750 is a cationic type material said to be fluorinated alkyl quaternary ammonium iodides while the FC-760 is a nonionic type said to be a fluorinated alkyl alkoxylate. Other materials which may be used are those available under the trademark "ZONYL" from du Pont with anionic and cationic materials said to be fluorosurfactants.

Other non-fluorochemical surfactants, with demonstrated activity in saline solutions such as the new class of brine resistant amphoteric surfactants described by Stournas (SPE#13029, 1984) may also be used advantageously to enhance the rate of freezing of a sea water spray. The various materials tested are those available under the tradenames of EMCOL 4500, L-3137, and Sulfonate OE, for example. These and the above described materials may be used in amount up to about 1,000 ppm, as will be described.

Ice nucleation agents may be used either alone or in combination with surfactants to enhance sea water spray freezing rates. When used alone, these agents prevent or minimize supercooling of the spray and thereby optimize freezing rates. When used in combination with surfactants, ice nucleation agents will provide for a more rapid and complete freezing of a sea water spray than would be possible if surfactant or ice nucleators were used alone. Use of ice nucleators to accelerate freezing of an impounded mass of sea water would also be beneficial. A variety of ice nucleation agents have been mentioned in the prior art with respect to the production of snow from a fresh water spray. These agents include inorganic and organic minerals and chemicals and microorganisms and may be used in salt or sea water.

LABORATORY INVESTIGATIONS

Initial laboratory tests of surfactants involved measurement of surface tension reduction for a variety of surfactants in synthesized sea water. The composition of the synthetic sea water was matched for calcium, magnesium, potassium, sodium, chloride, bicarbonate, carbonate and sulfate ions present in an average Beaufort Sea water. The water salinity was adjusted to 32,500 mg/l dissolved solids. The surface tension of the synthesized sea water and actual Beaufort Sea water were 73.6 dynes/cm and 73.5 dynes/cm, respectively by the DuNouy Ring method. The relationship between surface tension and temperature is linear to a first approximation. Measurements of surface tension of surfactant-treated sea water were made at two temperatures to permit evaluation of the rate of change of surface energy with temperature and to permit extrapolation of surface tension to temperatures of 0 degrees C. and below. The effective concentration of surfactants used in these tests was adjusted to 10, 50 and 100 ppm. The fluorochemical surfactants were the most efficacious of the tested surfactants. Two fluorochemical surfactants manufactured by 3M Company, FC-750 and FC-760, were subsequently further evaluated in field trials carried out in the Canadian Arctic.

A second series of laboratory tests were subsequently performed to better define the mechanism by which surfactants might accelerate sea water spray freezing rates. An apparatus was built to measure directly ice nucleation and bulk freezing temperatures of treated and untreated sea water. ASTM D97-66 pour point tubes with 40 ml graduations were instrumented with thermocouples and then placed in a freezer equipped with an air circulation fan and viewing port. The degree of supercooling and the actual freezing temperature of test solutions were then obtained. Temperature in the freezer was stabilized by use of the internal fan which minimized thermal gradients. A known ice nuleation agent with demonstrated activity in fresh water as described in the prior art (U.S. Pat. No. 4,200,228) was utilized as a standard for relative comparisons of ice nucleation behavior. The ice nucleating microorganisms, which has no measurable influence on sea water surface tension, were obtained from Advanced Genetic Sciences, Inc. of Greenwich, Conn. The microorganisms eliminated supercooling in the test solutions while the surfactants had little or no effect on supercooling. Thus, it can be inferred that surfactants can accelerate freezing of a sea water spray by encouraging more efficient droplet breakup whereas the ice nucleation agent are beneficial by virtue of their influence on diminishing supercooling. These experiments demonstrated that the benefit of treating sea water sprays or impounded masses of sea water with surfactant or ice nucleation agents occurs by separate and distinctly different mechanisms. In those applications where it would be desirable to treat sea water with both surfactant and ice nucleation agents, such as in the treatment of a sea water spray, the use of both types of additives would provide for more efficient freezing of the sea water than would be possible by the use of one or the other additive alone.

FIELD TRIALS

The utility of fluorochemical surfactants in construction of ice structures was evaluated in April, 1984 during the 1983–1984 field season at an offshore floating ice platform located North of the 77th parallel in the NW Territories. The ice platform was in use as an oil exploration site by an energy development company and drilling was ongoing when the spray freezing experiments were conducted. The ice platform consisted of an elliptical area of sea ice that had been thickened earlier in the season by a combination of spraying and flooding with sea water.

A surveyed grid was created for the field trials about two submersible pumps, each equipped with motor-driven, rotatable nozzle assemblies. Experiments were performed under essentially identical conditions of air temperature, wind velocity and direction and sea water pumping rate with and without surfctnat treatment. The ambient air temperature averaged −13 degrees F. This temperature is normally considered marginal for efficient production of ice from untreated sea water sprays. Treatment of sea water pumped at the rate of 350 to 450 gallons per minute with surfactant was accomplished using a high pressure metering pump. The surfactant dosage level was adjusted to range between 30 to 40 ppm.

Sea water spraying experiments were conducted for 2 to 3 hours. At the conclusion of each spray experiment, ice thicknesses were immediately obtained at various points on the grid by hand insertion of a ruled probe. A systematic characterization system was used to describe the nature of the sprayed material as ice, slush, brine, snow, etc. Contour maps of sprayed material thickness were also prepared. It was determined that ppm levels of fluorochemical surfactants FC-750 and FC-760 significantly increased the proportion of frozen versus unfrozen material across the surveyed grid. It was also observed that hand insertion of the ice thickness probe was, in many locations, not possible when surfactant-treated sea water had been sprayed. No difficulty was ever experienced with the hand insertion of the ice thickness probe after spraying with untreated sea water for equivalent time periods. These tests tended to indicate that the slush formation phase usually encountered with untreated salt water was markedly reduced and that the produced structure was of substantial strength with accelerated refreezing of the sprayed material and significant reduction in layering normally encountered in ice construction without the use of the procedures of this invention.

During the 1984-1985 field season, full scale testing of fluorochemical surfactant FC-760 was carried out in conjunction with the construction of an offshore ice platform in the NW Territories. Ice production rates from sea water sprays were two times greater then similar rates using untreated sea water sprays. The mechanical properties of ice produced with surfactant-treated sea water were indistinguishable from nominal properties of ice produced by use of untreated sea water. No detrimental impacts resulting from surfactant usage that might jeopardize the utility of a constructed ice platform with respect to loadbearing capacity were observed. It was found that at ambient air temperatures colder than −30 degrees C., surfactant usage encouraged the predominant formation of dry snow rather then hailstones providing further confirmation of the utility and effectiveness of surface tension reduction in accelerating freezing of a sea water spray. At temperatures colder than −30 degrees C., surfactant usage is unnecessary as an untreated sea water spray will freeze efficiently. Surfactant usage has as its primary benefit, the attainment of effective freezing rates for sea water sprays at relatively warm ambient air temperatures, warmer than −20 degrees C., when extended periods of sea water spraying would be counterproductive owing the relatively large proportion of sprayed water which does not freeze and which actually accelerates thawing of previously sprayed and frozen material. Thus, by the present invention, it is possible to start ice construction in the warmer portion of the Fall and to have the structure completed sooner in the season in order to provide longer use of the structure.

In a sea water spray, the salinity of unfrozen sea water increases significantly owing both to partial evaporation and salt rejection from freezing sea water. As a result of the much lower freezing temperature of partially evaporated sea water and concentrated brine formed as a result of salt rejection, thawing of ice contacted by unfrozen spray is accelerated to the point where spraying must be terminated for long periods to allow sprayed material to refreeze. To a great extent, the present invention markedly reduces this thawing and refreezing cycle thus allowing continued construction since the refreezing cycle is reduced or eliminated.

In another test, an ice island was constructed at Prudoe Bay, Alaska, some ten miles offshore in the Beaufort Sea area. The nozzle had an I.D. of 2¾ inches and salt water was fed by a pump producing 3,200 gallons per minute at about 200 psig. Droplet size was directed measured and in the range indicated of 1 to 30 mm.

It is preferred in the case of ice structures formed by spraying that both a surfactant and ice nucleator be used since droplet formation is promoted and supercooling is reduced markedly or eliminated. Furthermore, since the formation of ice structures by spraying involves some partial remelting and refreezing, use of ice nucleators tends to accelerate the freezing of translating or travelling water droplets as well as accelerating the freezing of the remelted fallen material. The use of both a surfactant and an ice nucleation agent tend to improve significantly the strength of the spray-formed ice structure. The amount of ice nucleation agent may be as is known in the prior patents referred to.

It is thus apparent that surfactants and ice nucleating agents each function in a different manner in the construction of ice structures and the use of both types of materials is preferred where the structure is formed by spraying. Thus, while the use of a surfactant material tends to promote droplet formation and thus accelerated freezing, the use of a nucleating agent further tends to eliminate or reduce supercooling thereby reducing the amount of unfrozen liquid in the droplet stream. The result is the marked reduction of slush formation and the more rapid build-up of ice of greater strength.

It will be apparent from the above detailed disclosure that various modifications may be made, based on the above detailed disclosure, and it is understood that such modifications as will be apparent to those skilled in the art are to be considered within the scope of the present invention as set forth in the appended claims.

We claim:

1. An improved method for the construction of load-bearing ice structures including ice platforms and grounded ice islands and the like wherein the ambient air temperature is in the range of about one degree C. to minus thirty degrees C. and wherein the structure is constructed from sea water, comprising the steps of:

adding to the sea water to be used in the construction of the load bearing ice structure an effective amount of a material selected from the group consisting of ice nucleation agents and fluorinated surfactants, fluorochemical surfactants, and amphoteric surfactants, and mixtures thereof, for the purpose of at least reducing the effect of supercooling in the case said ice nucleating agent and for reducing the surface tension of sea water in the case of said surfactants whereby solid ice is formed more quickly than in the absence of said material, and exposing said thus treated sea water to ambient air temperatures in the range of about minus 1 degree C. to minus 30 degrees C. thereby causing freezing to occur more completely by contact with the colder ambient than may be accomplished with untreated sea water exposed to the same ambient air temperatures and thus to form a load bearing ice structure.

2. A load bearing ice structure made in accordance with the method as set forth in claim 1.

3. An improved method for the construction of a load bearing ice structure from sea water wherein the ambient air temperature is in the range of one degree C. to minus thirty degrees C. comprising the steps of:

admixing with the sea water to be used in the construction of said load bearing ice structure an effective amount of at least a surfactant selected from the group consisting of fluorinated surfactants, fluorochemical surfactants, amphoteric surfactants, and mixtures thereof, forming a stream of said surfactant containing sea water, and directing said stream towards the area in which said load bearing ice structure is to be built whereby said surfactant promotes the formation, during transit of said stream, of droplets which freeze and fall to the ground as ice thus forming said load-bearing ice structure.

4. The method as set forth in claim 3 wherein said surfactant is added in an amount less than about one thousand *ppm of sea water.

5. The method as set forth in claim 4 wherein the amount of said surfactant is between thirty to forty *ppm.

6. The method as set forth in claim 3 further including the step of adding to said sea water an effective amount of an ice nucleating agent to reduce the effect of supercooling in the formation of said ice structure.

7. The method as set forth in claim 3 wherein said structure is a floating ice island.

8. A load-bearing ice structure made in accordance with the method of claim 3.

9. A method of forming a loadbearing ice structure from sea water in which the ambient air temperature is between one degree to minus thirty degree C., comprising the steps of:

adding a surfactant to the sea water to be used in the formation of said load-bearing structure, said surfactant being added in an amount effective to reduce the surface tension of said sea water and being selected from the group consisting of fluorinated surfactants, fluorochemical surfactants, amphoteric surfactants, and mixtures thereof, forming a continuous stream of the sea water to which said surfactant has been added and propelling said stream in a horizontal direction to location where said ice structure is to be formed whereby said stream is caused to travel a horizontal distance with the formation of drops, allowing said drops to freeze to form ice granules having a particle size in the range of between one and thirty mm whereby said ice granules fall to form a frozen ice mass, and continuing to propel a stream of surfactant containing sea water to said location to construct said load-bearing ice structure.

10. A method as set forth in claim 9 wherein said surfactants are added in amount of less than about one thousand parts per million of sea water.

11. A method as set forth in claim 9 further including the step of adding to said sea water at least one ice nucleating agent to reduce the effect of supercooling in the formation of said ice granules.

12. A method as set forth in claim 9 wherein said surfactant is selected from the group consisting of fluorinated alkyl quaternary ammonium iodides, fluorinated alkyl alkoxylates and brine resistant amphoteric surfactants.

13. A load-bearing ice structure made in accordance with the method of claim 9.

* * * * *